United States Patent [19]

Bruninx-Poesen et al.

[11] 4,422,011

[45] Dec. 20, 1983

[54] HIGH-PRESSURE MERCURY VAPOR DISCHARGE LAMP

[75] Inventors: Leonce M. J. Bruninx-Poesen; Peter C. Drop; Lambert C. I. Kaldenhoven; Roland Lorenz; Willy J. C. Endevoets, all of Eindhoven, Netherlands

[73] Assignee: U.S. Philips Corporation, New York, N.Y.

[21] Appl. No.: 307,129

[22] Filed: Sep. 30, 1981

[30] Foreign Application Priority Data

Oct. 2, 1980 [NL] Netherlands ..... 8005456

[51] Int. Cl.[3] ..... H01J 61/20

[52] U.S. Cl. ..... 313/642; 313/639

[58] Field of Search ..... 313/225, 227, 229

[56] References Cited

U.S. PATENT DOCUMENTS 3,334,261 8/1967 Butler et al. ..... 313/229
3,786,297 1/1974 Zollweg et al. ..... 313/225
3,798,487 3/1974 Zollweg et al. ..... 313/225
4,229,673 10/1980 McAllister ..... 313/225

FOREIGN PATENT DOCUMENTS 54-102070 8/1979 Japan ..... 313/229

*Primary Examiner*—Alfred E. Smith
*Assistant Examiner*—Carolyn E. Fields
*Attorney, Agent, or Firm*—Norman N. Spain

[57] ABSTRACT

High-pressure mercury vapor discharge lamp containing rare gas, mercury, sodium halide and at least one halide of at least one of the rare earth metals Ce, Pr, Nd and Lu. The lamp is suitable for a nominal power in the range from 10 to 2000 W. The molar ratio of rare earth metal to sodium, Ln:Na, has a value from 1:20 to 1:1 and the quantity of mercury, A, has a value from 2 to 100 mg/cm$^3$. Ln:Na and A have in these ranges a low value for lamps having a high value of the power, and higher values according as the nominal power of the lamp has a lower value.

3 Claims, 4 Drawing Figures

HIGH-PRESSURE MERCURY VAPOR DISCHARGE LAMP

Figure 1:
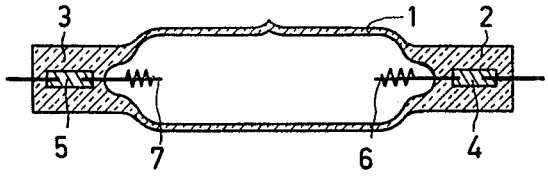

The invention relates to a high-pressure mercury vapour discharge lamp having a gas-tight, radiation-permeable discharge vessel, means for maintaining the discharge, and in addition an ionizable filling which contains a rare gas, mercury, a sodium halide and at least one halide of at least one of the rare earth metals cerium, praseodymium, neodymium and lutetium, the lamp being suitable for a nominal consumed power in the range from 10 to 2000 W. The said means for maintaining the discharge generally consist of electrodes provided in the discharge vessel. However, what is commonly denoted electrodeless operation of the lamp is alternatively possible, a high-frequency generator being used for maintaining the discharge.

Such a lamp is disclosed in, for example U.S. Pat. No. 3,334,261, which describes the possibility of using rare earth metals and their iodides in high-pressure mercury vapour discharge lamps. The rare earth metals have the advantage that they emit radiation having a spectral energy distribution consisting of a large number of very closely spaced emission lines, so that a quasi-continuum is obtained. The above-mentioned patent specification only describes examples of lamps whose filling consists of mercury, a rare gas and one of the rare earth metal iodides. The patent specification further mentions the possibility of adding sodium as an additional component to the lamp filling. The purpose of this measure is to stabilize the discharge arc and to reduce the starting voltage. The patent specification only mentions a wide range for the quantity of sodium which may possibly be used, but further details or examples of this measure are lacking.

The occurrence of a very constricted, unstable arc in lamps containing rare earth metal is a severe disadvantage, which results in such a reduction of the luminous efficacy and shortening of the operating life of the lamp that it becomes unfit for practical use. In order to improve the arc stability of these lamps, the addition of other halides were looked for. This resulted in suitable lamps, which contain a caesium halide in addition to a rare earth metal halide. Such lamps are disclosed in, for example, German patent specification No. 2,201,831 in which lamps are described which contain halides of Ce, Pr and Nd and, in addition a caesium halide. Although the addition of a caesium halide has the desired result these lamps have the great disadvantage that the colour aspect is not acceptable. It is therefore necessary to add further halides (among which the halides of Na, Dy and Sm are mentioned), in order to shift the colour point of the emitted radiation so that an improved colour aspect is obtained. This is, however, only partly successful as, because of the large number of components in the filling, the vapour pressure of these halides, which were added for colour correction purposes, is possibly reduced. Furthermore, because of the large number of components in the filling, it is very difficult to make these lamps in a reproducible manner.

The invention has for its object to provide lamps containing a rare earth metal and which combine a simple composition of the filling with a high luminous efficacy, a diffuse, stable discharge arc and a white colour aspect. A white colour aspect is here understood to mean that the colour point of the emitted radiation is located in the CIE-colour triangle on, or very close to the line of the black radiators.

According to the invention, a lamp of the type mentioned in the opening paragraph is characterized in that the molar ratio of the rare earth metal to the sodium, Ln:Na, has a value in the range from 1:20 to 1:1, and that the quantity of mercury per $cm^3$ volume of the discharge vessel, A, has a value in the range from 2 to 100 $mg/cm^3$, wherein Ln:Na and A each have in the said ranges a low value for lamps having a high value of the nominal power, and higher values according as the nominal power of the lamp has a lower value, so as to obtain a white colour aspect of the radiation emitted by the lamp.

The invention is based on the recognition of the fact that in a lamp containing a rare earth metal a satisfactory arc stability can be achieved by the addition of a sodium halide, if comparatively large quantities of the sodium halide are used. It has been found that with rare earth metal-containing lamps of a type in which the emitted radiation is predominantly located in the green portion of the spectrum, that is to say for lamps containing Ce, Pr, Nd or Lu, a suitable colour point of the emitted radiation can be obtained in addition to a proper arc stability by the use of comparatively large quantities of sodium halide. Consequently, in a lamp of the invention caesium halide for stabilizing the arc is no longer necessary and also the use of further halides to obtain a white colour aspect can be omitted.

From experiments which results in the invention, it has further been found that suitable lamps can only be obtained when the molar ratio of the rare earth metal to the sodium, Ln:Na, is chosen in dependent on the consumed power for which the lamp has been rated. This is a result of the fact that the mercury pressure in efficient, metal-halide containing lamps must be chosen in dependence on the power of the lamp, notably in that sense, that lamps having a low power require a high mercury pressure and lamps having a high power require a low mercury pressure. As the red edge of the sodium radiation appears to increase with an increasing mercury pressure, it is therefore necessary in order to obtain a white colour aspect, to chose for the molar ratio Ln:Na a high value (consequently comparatively little Na) at a high mercury pressure, that is to say for a lamp having a low value of the consumed power.

In a lamp of the invention the quantity of mercury per $cm^3$ volume of the discharge vessel, A, has a value from 2 to 100 $mg/cm^3$, the minimum value of A applying to lamps having a high value of consumed power (for example approximately 2000 W). According as the wattage of the lamp is lower a higher value of A must be used in order to obtain an efficient lamp, the said maximum value of A applying to lamps having a very low value of consumed power (for example 10 W). It has now been found that the ratio Ln:Na should be chosen in the range 1:20 to 1:1, it being necessary, to obtain a white colour aspect, to use the above minimum value (1:20) for lamps of a high power (for example approximately 2000 W) and the maximum value (1:1) for lamps of a very low power (for example 10 W). If, in a lamp of a certain power, one deviates too much from the optimum value of the ratio Ln:Na for that lamp it has been found that the emitted radiation then does not have a white colour aspect. It has namely been found that at too high values of Ln:Na, the contribution of the Na-radiation is too low and that the lamp has a green colour aspect (colour point above the line of the black radiators). If Ln:Na is too small, the Na-contribution is too great so that the colour point is shifted too far below the line of the black radiators and also then no white colour aspect is obtained.

Preference is given to a lamp in accordance with the invention, which is characterized in that the lamp is suitable for a power in the range from 20 to 400 W, that the filling contains cerium and/or praseodymium in a quantity from 1 to 25 μmol per $cm^3$ volume of the discharge vessel, and that Ln:Na has a value in the range from 1:4 to 1:12. It has been found that comparatively small lamps (20–400 W) which contain Ce and/or Pr have an optimum arc stability and colour point correction if Ln:Na is chosen in the above-defined range, the Ce and/or Pr being used in a quantity from 1 to 25μ mole/$cm^3$. Of course low values of Ln:Na are chosen here also for lamps of a higher wattage and higher values for lamps of a lower wattage.

A second preferred embodiment of a lamp of the invention is characterized in that the lamp is suitable for a power in the range from 20 to 400 W, that the filling contains neodymium and/or lutetium in a quantity from 1 to 25μ mole per $cm^3$ volume of the discharge vessel, and that Ln:Na has a value in the range from 1:2.5 to 1:7. It has been found that an optimum arc stability and colour point correction is obtained for Nd and/or Lu-containing lamps at somewhat higher values for Ln:Na than used for the Ce and/or Pr-containing lamps.

Embodiments of lamps of the invention will now be further described with reference to the accompanying drawing and a number of measurements.

In the drawing

Figure 2:
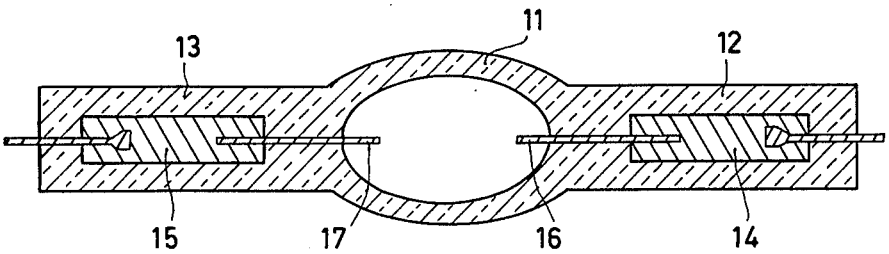
Figure 3:
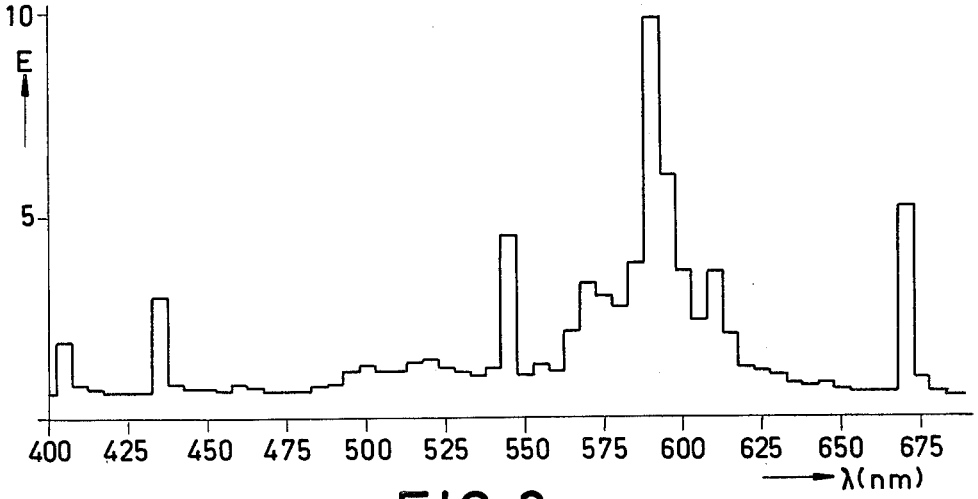
Figure 4:
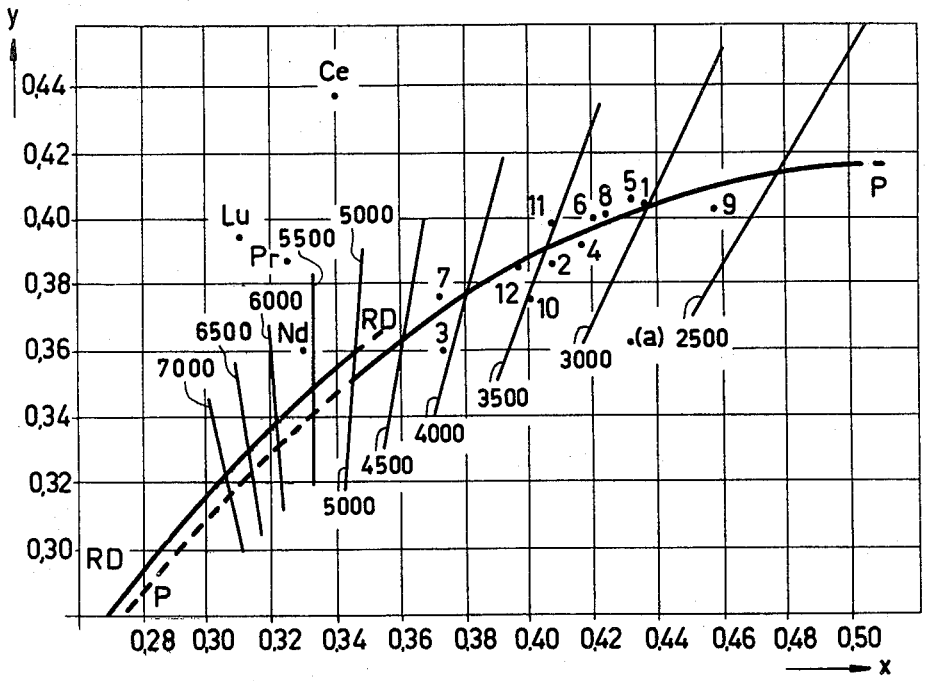

FIG. 1 is a cross-sectional view of a high-pressure mercury vapour discharge lamp of the invention, intended for a consumed power of 400 W and FIG. 2 is a cross-sectional view of such a lamp intended for a power of 30 W, FIG. 3 shows the spectral energy distribution of a lamp having a construction as shown schematically in FIG. 1, and FIG. 4 shows a portion of the CIE-colour triangle.

In FIG. 1, reference numeral 1 denotes the quartz glass discharge vessel of a lamp of the invention having a nominal power of 400 W. Each end of the vessel 1 is provided with a pinch 2 and 3, respectively, into which the current supply elements 4 and 5 have been sealed. In the vessel 1 these supply elements are connected to tungsten electrodes 6 and 7, respectively, between which the discharge takes place during operation of the lamp. The discharge vessel 1 has an inside diameter of 15.5 mm and a volume of 7 $cm^3$. The electrode spacing is 40 mm. The discharge vessel 1 is incorporated in an evacuated outer bulb (not shown).

The lamp of FIG. 2 is suitable for a nominal power of 30 W and has an oval, quartz glass discharge vessel 11 (wall thickness approximately 1 mm). Molybdenum foils 14 and 15, respectively, which serve as current supply conductors, are sealed within the ends 12 and 13, respectively. These foils are connected to the electrodes 16 and 17, respectively, which have been provided in the discharge vessel 11 and are in the form of tungsten pins (diameter approximately 0.2 mm). The discharge vessel 11 has a largest inside diameter of 4 mm and a volume of 0.07 $cm^3$. The electrode spacing is 4.5 mm. Also the lamp of FIG. 2 is positioned in an evacuated outer buld (not shown in the drawing).

EXAMPLES 1 TO 4

Four lamps of a construction as shown in FIG. 1 (400 W) were produced. These lamps were provided with argon up to a pressure of 3300 Pa and in addition to mercury, sodium iodide and Ce, Pr, Nd or Lu iodide, respectively in the following quantities:

| Example | $LnI_3$ | (μmol) | NaI(μmol) | Ln:Na | Hg(mg) |
|---|---|---|---|---|---|
| 1 | $CeI_3$ | 25 | 250 | 1:10 | 32 |
| 2 | $PrI_3$ | 25 | 250 | 1:10 | 32 |
| 3 | $NdI_3$ | 13 | 65 | 1:5 | 25 |
| 4 | $LuI_3$ | 25 | 125 | 1:5 | 32 |

The lamps were measured for the luminous efficacy η (in lumen/W), the colour point (x; y) and the colour temperature $T_c$ (in K.) of the emitted radiation:

| Example | η (1 m/W) | x; y | $T_c$ (K) |
|---|---|---|---|
| 1 | 112 | .436; .403 | 3015 |
| 2 | 98 | .407; .386 | 3400 |
| 3 | 80 | .373; .360 | 4085 |
| 4 | 105 | .416; .392 | 3278 |

The optimum value of Ln:Na for the Nd and Lu-containing lamps was found to be higher than the optimum value of the Ce and Pr containing lamps. The four lamps burn steadily and have a white colour aspect. The spectral energy distribution of the lamp of example 1 is shown in the graph of FIG. 3. In this graph there are plotted on the horizontal axis the wavelength λ in nm and on the vertical axis the emitted radiant energy E per wavelength interval of 5 nm in arbitrary units.

EXAMPLES 5 TO 8

Four lamps, also intended for a power of 400 W, but with a shape which differs from the shape of the lamp shown in FIG. 1 were produced. The tubular quartz glass discharge vessel had an inside diameter of 11.5 mm and had conical ends. The electrode spacing was 37 mm and the volume of the vessel was 4 $cm^3$. In addition to argon to a pressure of 3300 Pa these lamps, which during operation were subjected to a higher wall load than the lamps of examples 1 to 4, contained:

| Example | η $LnI_3$ | (μmol) | NaI(μmol) | Ln:Na | Hg(mg) |
|---|---|---|---|---|---|
| 5 | $CeI_3$ | 25 | 250 | 1:10 | 14 |
| 6 | $PrI_3$ | 25 | 250 | 1:10 | 14 |
| 7 | $NdI_3$ | 13 | 65 | 1:5 | 12 |
| 8 | $LuI_3$ | 25 | 125 | 1:5 | 14 |

From a comparison between the 5 to 8 lamps with the 1 to 4 lamps, it appears that at the same wattage, Ln:Na and the quantity of mercury (in mg/$cm^3$) have substantially the same optimum value, but that the quantity of $LnI_3$ (and also NaI) per $cm^3$ may vary. Namely, these quantities also depend on the shape of the discharge vessel (tubular, ovoid or spherical). The measurements on the lamps 5 to 8 which burn steadily, are summarized as follows.

| Example | (1 m/W) | x; y | $T_c$ (K) |
|---|---|---|---|
| 5 | 115 | .432; .406 | 3090 |
| 6 | 115 | .420; .400 | 3260 |
| 7 | 99 | .372; .376 | 4230 |

-continued

| Example | (1 m/W) | x; y | $T_c$ (K) |
|---|---|---|---|
| 8 | 98 | .424; .401 | 3180 |

EXAMPLE 9

A lamp suitable for a consumed power of 2000 W had a tubular discharge vessel having an inside diameter of 40.5 mm and a volume of 107 $cm^3$; the electrode spacing was 85 mm. The lamp contained 125$\mu$ mole $CeI_3$ and 2500$\mu$ mole NaI (Ln:Na=1:20) and in addition 272 mg Hg and a quantity of rare gas as a starting gas. A luminous efficacy of 120.4 lm/W a colour temperature of 2670 K. and a colour point x; y=0.457; 0.403 were measured with the steadily burning lamp.

EXAMPLE 10

A lamp intended for a power of 125 W, and having an ovoid discharge vessel having an inside diameter of 8 mm, an electrode spacing of 8 mm and a volume of approximately 0.6 $cm^3$ had a filling consisting of 5$\mu$ mole $CeI_3$, 37.5$\mu$ mole NaI (Ln:Na=1:7.5) and 16.6 mg Hg and a rare gas as a starting gas. During operation this lamp showed no instability and the following values were measured: $\eta$=86 lm/W, $T_c$=3500 K. and x; y=0.400; 0.375.

EXAMPLE 11

A lamp having a construction as shown in FIG. 2 (30 W) was provided with 3300 Pa of argon and in addition with 2.25 mg Hg, 0.85 mg $CeI_3$ and 1.22 mg NaI (Ln:Na=1:5). The lamp burned steadily (lamp voltage 123 V, lamp current 0.28 A) and the following values were measured $\eta$=88 lm/W, $T_c$=3440 K., x;y=0.407; 0.389. This lamp, which is very suitable for interior lighting had, in addition to a high efficiency and a white colour aspect, also a good colour rendition (Ra=71).

EXAMPLE 12

A lamp having a construction as shown in FIG. 2 (30 W), containing 3300 Pa of argon, 2.60 mg Hg, 0.57 mg $CeI_3$ and 0.80 mg NaI (Ln:Na=1:4.9) was found to have in operation (lamp voltage 116 V, lamp current 0.308 A) a luminous efficacy of 84.7 lm/W, a colour temperature of 3515 K. and a colour point x;y=0.402; 0.385. The colour rendering index Ra was 66.

FIG. 4 shows a portion of the CIE colour triangle. In this graph the x and y-co-ordinates of colour points are plotted on the x- and y-axis. P and RD denote the line of the colour points of black radiators and of daylight radiation, respectively. In addition, 2500, 3000, . . . 7500 denote the lines at which the colour points with colour temperature (in K.) of these values are located. Ce, Pr, Nd and Lu denote the colour points of pure Ce, Pr, Nd and Lu-radiation, respectively. These colour points are far above the lines P and RD in the green portion of the colour triangle. The points 1 to 12 denote the colour points of the lamps in accordance with the examples 1 to 12. It is clearly shown that the lamps according to the invention have a colour point at or very close to the line P and they consequently have a white colour aspect. For the purpose of comparison a lamp was made which was substantially identical to the lamp of example 12, the difference being that the quantity of Ce was halved and, consequently, Ln:Na was substantially equal to 1:10. This lamp, which contained relatively too much Na had a colour point x; y=0.431; 0.362 and a magenta colour aspect. The colour point of this lamp is shown in FIG. 4 by (a). It further appeared that this lamp produces 84.3 lm/W and that it has a Ra of approximately 37.

What is claimed:

1. A high-pressure mercury vapour discharge lamp, the emitted radiation of which has a white color aspect, comprising a gas-tight, radiation-permeable discharge vessel, means for maintaining a discharge and in addition an ionizable filling within said discharge vessel consisting of a rare gas, mercury, a sodium halide and at least one halide of at least one of the rare earth metals selected from the group consisting of cerium, praseodymium, neodymium and lutetium, the lamp being suitable for a nominal consumed power in the range of from 10 to 2000 W, characterized in that the molar ratio of the rare earth metal Ln to sodium, Ln:Na, has a value in the range from 1:20 to 1:1, and that the quantity of mercury per $cm^3$ volume of the discharge vessel, A, has a value in the range from 2 to 100 mg/$cm^3$, wherein Ln:Na and A values are in inverse relationship to the value of said nominal consumed power.

2. A high-pressure mercury vapour discharge lamp as claimed in claim 1, characterized in that the lamp is suitable for a nominal consumed power in the range from 20 to 400 W, that the filling contains the halides of cerium and/or praseodymium in a quantity from 1 to 25$\mu$ mole per $cm^3$ volume of the discharge vessel, and that Ln:Na has a value in the range from 1:4 to 1:12.

3. A high-pressure mercury vapour discharge lamp as claimed in claim 1, characterized in that the lamp is suitable for a nominal consumed power in the range from 20 to 400 W, that the filling contains the halides of neodymium and/or lutetium in a quantity from 1 to 25$\mu$ mole per $cm^3$ volume of the discharge vessel, and that Ln:Na has a value in the range from 1:2.5 to 1:7.

* * * * *